US007642911B2

(12) United States Patent
Desrosiers et al.

(10) Patent No.: US 7,642,911 B2
(45) Date of Patent: Jan. 5, 2010

(54) MULTIPLE CHILD UNIT MONITOR SYSTEM

(75) Inventors: Craig Desrosiers, Spring City, PA (US); Jeffrey Swan, West Chester, PA (US)

(73) Assignee: Graco Children's Products Inc., Atlanta, GA (US)

( * ) Notice: Subject to any disclaimer, the term of this patent is extended or adjusted under 35 U.S.C. 154(b) by 281 days.

(21) Appl. No.: 11/672,693

(22) Filed: Feb. 8, 2007

(65) Prior Publication Data

US 2007/0236344 A1 Oct. 11, 2007

Related U.S. Application Data

(60) Provisional application No. 60/789,700, filed on Apr. 5, 2006.

(51) Int. Cl.
*G08B 1/08* (2006.01)

(52) U.S. Cl. ..... 340/539.1; 340/539.15; 340/573.1; 340/815.4

(58) Field of Classification Search ..... 340/539.15, 340/573.1, 539.1, 539.11, 815.4, 815.45, 340/691.1, 692
See application file for complete search history.

(56) References Cited

U.S. PATENT DOCUMENTS 7,088,259 B2 * 8/2006 Armbruster et al. .... 340/815.46
7,098,785 B2 * 8/2006 Wong et al. ..... 340/539.15
7,151,444 B1 * 12/2006 Doyle ..... 340/539.1
7,251,334 B1 * 7/2007 Sundberg ..... 381/56
2005/0093693 A1 5/2005 Wong et al.

OTHER PUBLICATIONS

User Guide, Safety 1st Home Connection Monitor System, Dorel Juvenile Group, Model No. 08038, pp. 1-10 (2004).

* cited by examiner

*Primary Examiner*—Toan N Pham
(74) *Attorney, Agent, or Firm*—Lempia Braidwood LLC

(57) ABSTRACT

A monitor system has at least first and second child units that can each monitor audio at a different location and can each transmit signals representative of the audio monitored. A parent unit can receive the signals from the first and second child units. In one aspect, the parent unit can have at least one multi-color notification light that can be illuminated in a first color when receiving the audio monitored by the first child unit and a second color different from the first color when receiving the audio monitored by the second child unit. In another aspect, the parent unit can emit an audible notification representing the audio monitored by each of the child units. In this aspect, a volume control is in communication with the parent unit and can be operated to adjust a volume level of the emitted audible notification for each of the child units independent of the other child units. In yet another aspect, the parent unit can emit a notification representing each of the signals and can sequentially listen for the first child unit for a first duration and at least the second child unit for a second duration during a listening cycle. In this aspect, the parent unit can continuously repeat the listening cycle and the first and second durations can be adjusted by a user to a different duration selected from a plurality of different duration options.

37 Claims, 3 Drawing Sheets

2 min
1 min
30 sec
10 sec
Off
A B C D E
80A 80B
70 72 74 76
82 84 86
90 92 94A 94B 88 22 24 64 66
100A 100B 100C 100D 100E
102A 102B 102C 102D 102E
110A 110B 110C 110D 110E
120

MULTIPLE CHILD UNIT MONITOR SYSTEM

RELATED APPLICATION DATA

This patent is related to and claims priority benefit of prior filed U.S. Provisional Application Ser. No. 60/789,700, which was filed on Apr. 5, 2006.

BACKGROUND OF THE INVENTION

1. Field of the Disclosure

The present disclosure is generally directed to child monitor systems, and more particularly to a system that has at least one receiver or parent unit capable of monitoring two or more transmitters or child units.

2. Description of Related Art

Conventional child monitor systems typically have a receiver or parent unit and a transmitter or child unit that communicate with one another. The transmitter is typically placed in the room or environment of the child and the receiver is typically placed remote from the child's environment in a room or location of the parent. The transmitter conveys or transmits audio signals from within the child's environment to the receiver. Some child monitor systems come with two or more child units. However, in a typical child monitor system, the parent unit is equipped to only receive signals from one child unit during use, not both. In such systems, a parent must typically select which child unit to monitor by setting or positioning a selector on the parent unit. The receiver typically can not monitor both child units during use.

A child monitor system is provided by SAFETY 1$^{st}$ and is known as the "Home Connection Monitor System No. 08038." This system is provided with three child units and two parent units. Each parent unit can operate in one of two selected modes. In a first mode, buttons on each parent unit can be pushed to select one of the three child units to monitor. In a second mode, a button on the parent unit can be pushed to enable automatic sequential and repeated monitoring from one child unit to the next. In this mode, the parent unit monitors each child unit for three seconds before changing to the next child unit. This system will continuingly monitor each child unit for three seconds and then move on to monitor the next child unit.

The SAFETY 1$^{st}$ system is described in U.S. Pat. No. 7,098,785, which and discloses the system as having a receiver capable of operating in a first mode for sequentially announcing the transmitted audio from the transmitters and a second mode for announcing the transmitted audio from a selected transmitter. Thus, this patent describes a system that can operate in one mode where the parent unit monitors only a selected one of the child units and in another mode where the parent unit monitors each of the child units in a sequential periodic fashion. The SAFETY 1$^{st}$ system parent unit includes separate indication light for each of the three child units. The light for a particular unit being monitored at any given time is illuminated. In each mode, the SAFETY 1$^{st}$ system can only monitor one child unit at a time, regardless of the mode of operation, so there is no difficulty determining which child unit is picking up audible sounds heard at the parent unit.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The present disclosure is for a child monitor system that employs at least one parent unit that can monitor more than one child unit at the same time. The disclosed child monitor system employs a parent unit configured to sequentially announce or indicate the transmitted audio from a plurality of transmitters or child units. The monitor system disclosed herein can automatically monitor the audio from each child unit in turn. In one example, the time spent monitoring each child unit can be independently adjusted for each child unit by the user of the system. In another example, the volume of the transmitted audio of each of the child units can be independently adjusted. The disclosed system in one example can be adjusted so that the time spent monitoring a selected one of the child units can be significantly longer in duration than the time spent monitoring the other child units. The disclosed system in one example can be adjusted so that the volume of the audio signal transmitted from one of the child units can be adjusted much higher or lower than the volume of the other child units transmitting.

Figure 1:
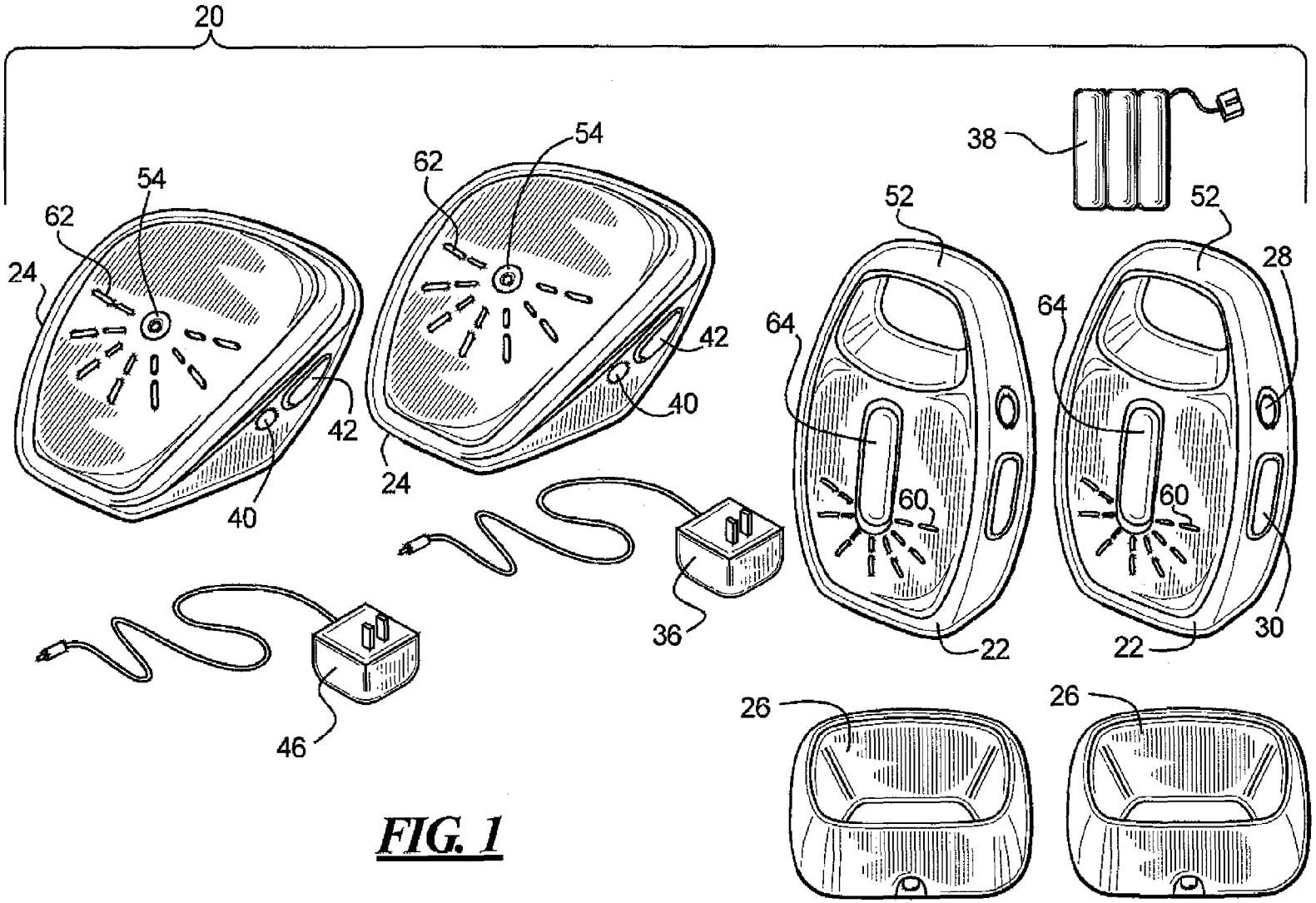
FIG. 1 is a perspective view of one example of a child monitor system constructed in accordance with the teachings of the present invention.

Turning now to the drawings, FIG. 1 illustrates the basic components of one example of a child monitor system 20 constructed in accordance with the teachings of the present invention. In this example, the system is provided with two receivers or parent units 22 and two transmitters or child units 24. As will be evident to those having ordinary skill in the art, fewer or more than one parent unit and/or more than two child units can also be provided as part of the system without departing from the spirit and scope of the present invention. There may be instances where one aspect or feature disclosed herein may be particularly suited for a monitor system that incorporates multiple parent units or more than a pair of child units.

Figure 2B:
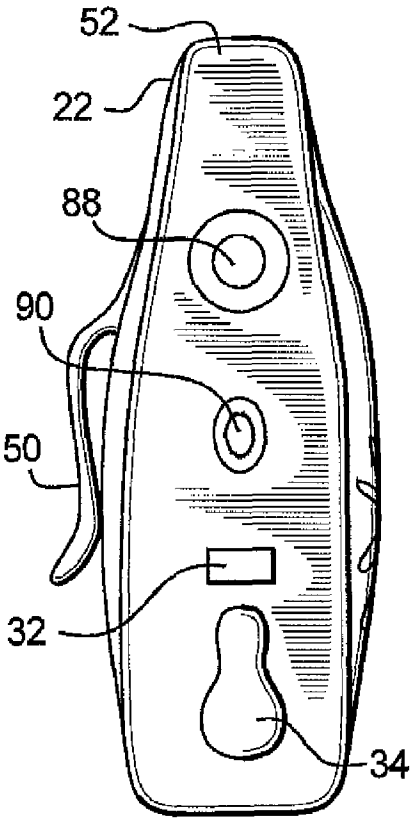
FIGS. 2A and 2B are opposite side views of one of the parent units or receivers of the system show in FIG. 1.
Figure 2A:
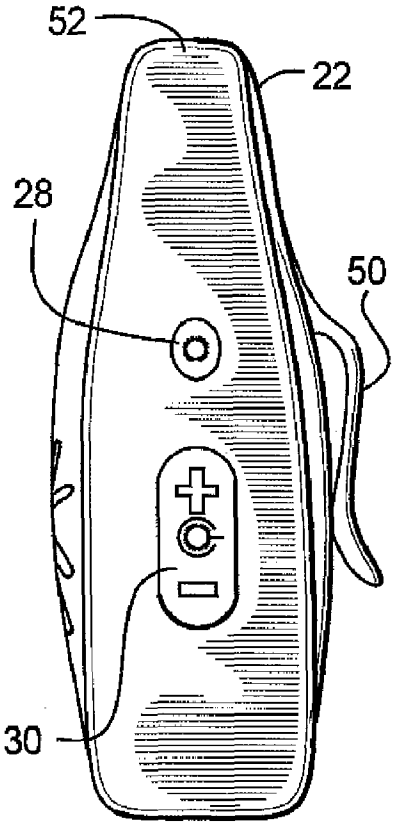

As is known in the art, a docking station 26 can be provided for the parent units 22 and be configured to plug into an AC wall jack. The parent unit can be configured to rest in the docking station to recharge its batteries and operate on AC power. In one example, the docking station 26 can be configured to receive either of the parent units. Alternatively, multiple docking stations 26 can be provided with a system having two or more parent units 22, one docking station for each of the multiple parent units 22. FIGS. 2A and 2B depict the opposite sides of one of the parent units 22 shown in FIG. 1.

In this example, the parent units 22 each have an on/off power button 28 and a toggle-type volume up and volume down switch 30 on one side.

A battery indicator light 32 is provided on the other side of each of the parent units 22 and is operatively connected to the batteries of the unit. This side of each of the parent units 22 also has a DC adapter jack 34 with a rubber cover that covers the opening. An AC adapter 36 can be provided with the system, or two adapters can be provided if two parent units come with the system. In this example, each parent unit can thus be powered using an ordinary AC source either via the AC adapter 36 and adapter jack 34; or via the docking station 26. Alternatively, the system can be provided with a DC battery source for each of the parent units 22, such as a rechargeable battery pack 38, so that the parent units can run on DC power alone, if desired.

In one example, the battery indicator light 32 can illuminate in more than one color and, in one example, can illuminate green either when recharging or when being operated remotely on DC power while having a good battery charge. The light 32 can illuminate red when the batteries 38 are low to indicate to a user that the batteries should be recharged or replaced, if not rechargeable. The indicator 32 can be provided as a dual-color light-emitting diode (LED) or other type of indicator. Alternatively, two separate green, red, or other color lights could be provided on the units instead to perform these functions. As will be evident to those having ordinary skill in the art, many other examples can employ different configurations and constructions relative to the docking station, the shells and shapes of the parent units 22, and the types, arrangement, and functions of the buttons, switches, lights, and the like of the parent units 22.

Figure 3:
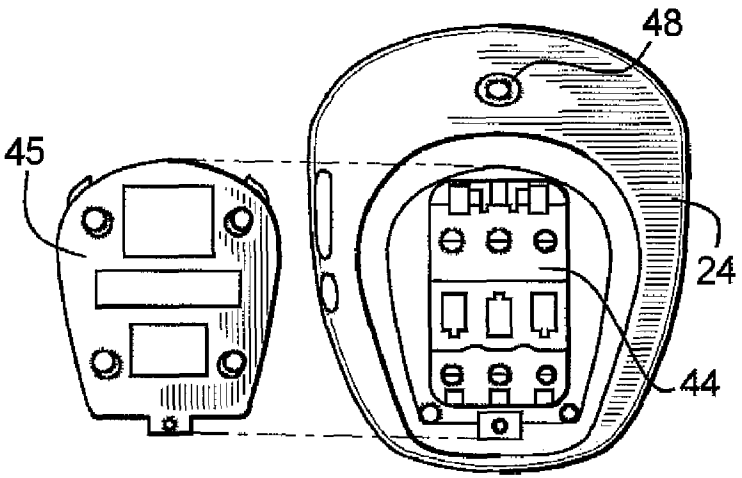
FIG. 3 is a bottom and rear view of one of the child units or transmitters of the system shown in FIG. 1.

As shown in FIG. 1, an on/off button 40 is also provided on one side of each of the child units or transmitters 24 in this example. A channel selector switch 42 is also provided on that same side of each child unit 24 in this example. As is known in the art, each child unit (as well as the parent units 22, though not shown) can also be provided with a battery compartment 44, which is on the bottom of the units in this example, as shown in FIG. 3, and has a typical removable battery cover 45. The battery compartment 44 can be configured for conventional disposable dry cell batteries or for a rechargeable battery pack (similar to the battery pack 38 for the parent units). The disclosed system can also be provided with one or more conventional AC adapters 46 for the child units 24. The child units 24 can thus also each have a DC adapter jack 48, which is on the back of the units in this example. Thus, each of the parent and child units 22 and 24 can operate either by on-board, rechargeable or replaceable batteries, or by externally supplied AC power using the AC adapters 36 and 46, a conventional AC wall jack, and/or the docking stations 26.

The above-described features of the parent units 22 and the child units 24 are similar to features found in other child monitor systems. Additionally, the parent units 22 can be provided with a belt clip 50, shown in FIGS. 2A and 2B, as is also known in the art. The parent units can further be provided with an opening through the shell near the top end to create a handle 52 that can be used to easily carry the parent units. Thus, the disclosed parent units 22 can be carried by a parent easily from room to room if they are moving about and yet wish to remotely monitor a child.

As shown in FIG. 1, each of the child units or transmitters 24 has a power LED 54 on a front surface of the unit shell. In one example, the power LED 54 can also operate in a dual-color mode such as in either a red or a green mode. The green LED can be used to indicate that the unit is connected to a power source and turned on and, if running on batteries, that the batteries are sufficiently charged. A red LED can be used to indicate that the unit is on, but that the batteries are low and require recharging. Again, two separate lights could be used for this function, if desired and if provided.

In the disclosed example, the parent units or receivers 22 have an array of elongate shapes 60 on the front surface of the unit shell. One or more of these shapes 60 can be open to a speaker (not shown) provided within the unit shell to permit sound from the speaker to readily emanate from the shell. Similarly, each of the child units or transmitters 24 in the disclosed example has an array of elongate shapes 62 on the front surface of the unit shell that surround the power LED 54. One or more of these shapes 62 can also be open through the child unit shell and located adjacent to a microphone disposed within the unit so that the unit can pick up sounds in the environment in which the unit placed. The speaker in the parent units emit audible sound in one example so that a parent can hear the audio signals picked up and transmitted by a child unit 24. As will be evident to those having ordinary skill in the art, the size, shape, color, intensity, position, and the like of the power LED on the child unit and the number, shape, arrangement, orientation, and the like of the various shapes and openings 60 and 62 in the unit can vary considerably and yet fall within the spirit and scope of the present invention. The disclosed invention is not intended to be limited to any particular design details of these features. The various non-open shapes 60 and 62 can be for decorative purposes and can vary as desired.

As shown in FIG. 1, each of the parent units or receivers 22 has a light bar region 64 on the front surface. A conventional light bar region might typically employ a plurality of lights operated in series. Such a conventional light bar displays the intensity or volume of audio being monitored in the vicinity of a child unit. Typically, more of the series of lights on the parent unit are illuminated to indicate greater audible activity or louder audio being monitored. Fewer of the lights are typically illuminated to indicate lesser audible activity or quieter audio. The disclosed light bar region 64 can take on a number of different configurations and can operate to perform additional or alterative functions within the spirit and scope of the present invention. Alternative examples of light bar regions with varying configurations and operational characteristics are described in greater detail below when describing various aspects and features of the present invention.

However, in each example, a single connection light 66 (shown in FIGS. 5 and 6) can be provided on the parent units 22, either as part of the light bar region 64 or on the unit but remote from the light bar region. In one example, the disclosed connection light 66 can be a red loss-connection light. The light 66 can be used to indicate, when off, a good connection between the parent and child units when in use. The light can be configured so that it is red and illuminated when there is a bad connection or no communication between a parent unit 22 and a child unit 24. In a reverse example, the connection light 66 can be illuminated when there is a good connection and be turned off when there is a bad connection. In a further example, the connection light 66 can be a dual-color LED, or can employ two separate, different colored lights, and can be illuminated in one color such as green when there is a good connection and in a different color such as red when a bad or lost connection occurs between the parent unit 22 and one of the child units 24.

The above-described parent units 22 and child units 24 and their various buttons, lights, switches, and accessories are generally incorporated into each of the more detailed descriptions provided herein using the above reference numbers. A number of features of the present invention are described below with reference to the system 20 described above and shown in FIGS. 1-3. Again, as will be evident to those having ordinary skill in the art, the configuration, arrangement, positioning, availability, and the like of the parent and child unit shells, lights, buttons, and switches can vary considerably and yet fall with the spirit and scope of the present invention. FIGS. 1-3 are provided herein merely for the purpose of depicting the general aspects of a child monitor system adapted and configured in accordance with the teachings of the present invention.

Figures 4, 5, 6, 7:
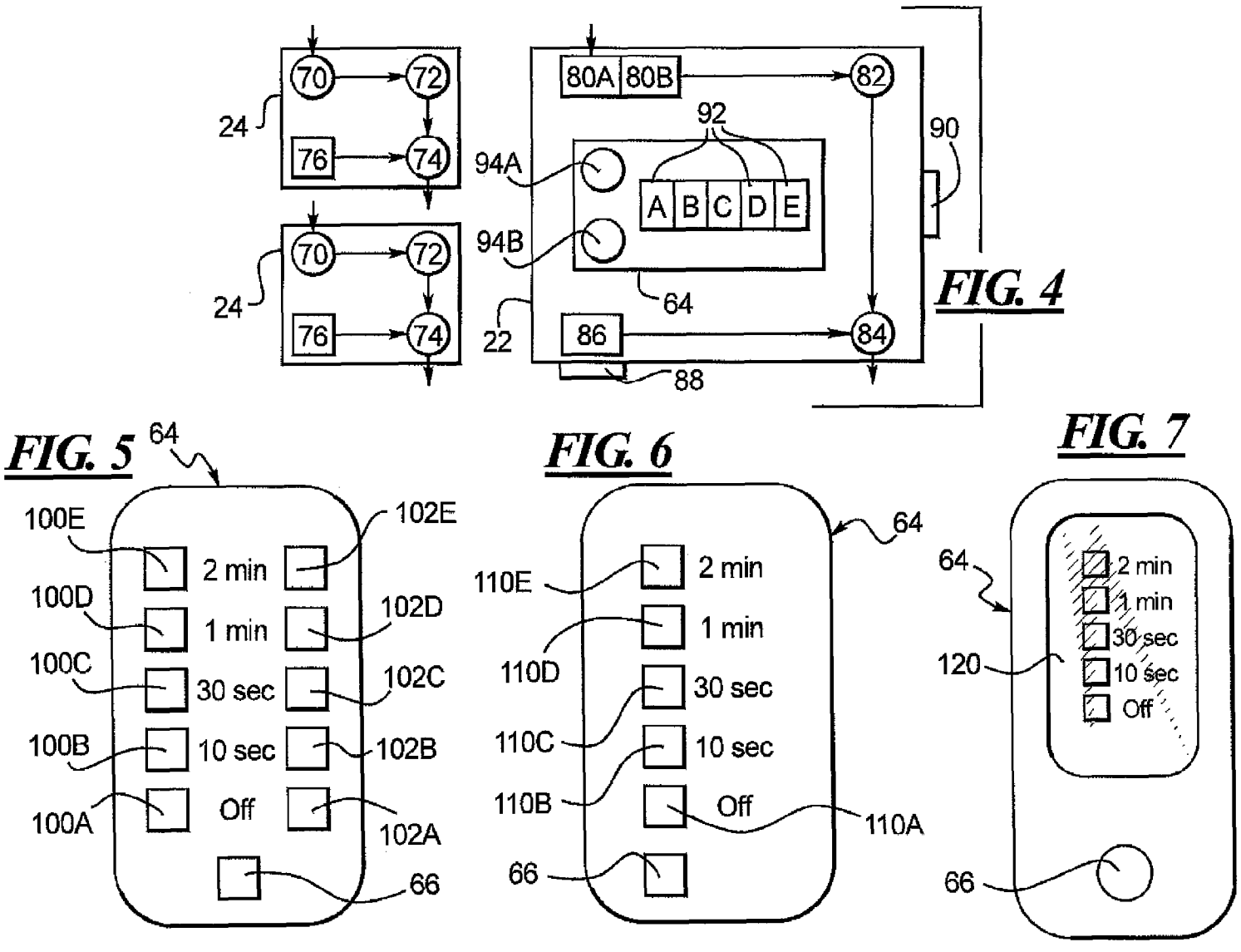
FIG. 4 is a schematic representation of one example of a child unit and a parent unit configured in accordance with the teachings of the present invention, the parent unit including one example of a light bar region configuration.
FIG. 5 is an enlarged view of another example of a light bar region for a parent unit or receiver of a system shown in FIGS. 1 and 4.
FIG. 6 is an enlarged view of yet another example of a light bar region for a parent unit or receiver of a system shown in FIGS. 1 and 4.
FIG. 7 is an enlarged view of still another example of a light bar region for a parent unit or receiver of a system shown in FIGS. 1 and 4.

FIG. 4 is a schematic of one example of a configuration for a child monitor system 20, including a parent unit and two child units, constructed in accordance with the teachings of the present invention. In this example, the system can be adjusted by a user to determine the amount of time that each child unit 24 is monitored by the parent unit 22. In this example, each child unit 24 has a microphone 70 that picks up sound or audio within the vicinity of the unit. Each child unit 24 also has an amplifier 72 that can be provided to amplify the audio picked up by the microphone 70, if desired. The child units also each have a signal transmitter 74 that can convert the audio signal to an electronic or wireless signal to be transmitted from the units 24. In the disclosed example, the audio can be converted to a modulated radio frequency (RF) signal.

The child units can be configured to have a preset RF channel at the factory, whereby each of the units 24 could be set to operate at a different frequency. Alternatively, the transmitter 74 of each child unit can be manufactured to operate within a range of selectable frequencies, and the frequency selection process and/or mechanism can be such that both child units can not possibly transmit at the same frequency during use at the same time. In this example, each child unit 24 is provided with such a transmitter 74. A user can depress the channel selection button 42 to operate an RF channel control device 76. The parent unit 22 can be configured to initially scan all of the available channels for one child unit until it locks onto the correct channel for that unit, and then do the same for each additional child unit. The channel or transmit frequency for each child unit can be stored and recalled by the parent unit to allow for fast switching between child units. Each child unit 24 can be placed in a different room to monitor and pick up sound or audio through its own microphone 70. Each unit can then transmit at the selected channel or frequency an RF signal representative of the monitored audio. The disclosed system 20 can also be provided with more than two child units, as desired. Each unit can be constructed similar to the other units and can be fabricated so that the child units can transmit at different RF or other signal frequencies.

In the illustrated example, the parent unit 22 is provided with two distinct receivers 80A and 80B, each dedicated to receive the signals transmitted by a particular one of the child units 24. Thus, the parent unit can simultaneously receive the signals from both child unit transmitters 74. Three or more distinct receivers could be provided in the parent unit 22 corresponding to the number of child units 24, if the system 20 is provided with more than two child units. The receivers 80A and 80B can be configured to search for and lock onto the respective child units as noted above, if the child units 24 are provided with a channel selection mode. The receivers 80A and 80B can also be configured to convert the RF or other electronic signal format from the child units 24 into audio signals. The two audio signals could also be added together or combined and played or emitted by the speaker simultaneously, or the parent unit could play or emit each audio signal separately for a period of time.

In another example, the parent unit can be provided with only a single receiver, eliminating one of the receivers 80A or 80B. In this example, each child unit can transmit on a different channel and each can transmit continuously. The parent unit in this example can first scan all available channels until locating the transmission channel for the first child unit. When located, the channel for the first child unit can be stored by the parent unit for later retrieval. The parent unit can then scan all available channels to locate the transmission channel for the second child unit and store that channel for later retrieval. The parent unit can then set the receiver channel to the transmission channel of the first child unit for a period of time. The parent unit can subsequently set the receiver channel to the transmission channel for the second child unit for a period of time, and then repeatedly cycle among each of the child unit transmission channels. The receiver channel adjustment between the child unit channels is very fast, on the order of milliseconds. The user would not notice any delay as the parent unit cycles continuously between the child unit channels.

In still another example, a parent unit 22 could again be provided with only a single receiver, and yet still listen to two child units that transmit on the same frequency or channel. This can be accomplished by having the child units alternate their transmissions. With both child units transmitting on the same channel or frequency, the child units can not transmit at the same time or the transmissions will be corrupted. One will transmit for a short time and then stop. Then the other will transmit for a short time and then stop. This is known as Time Division Multiplexing. In one example, this can be accomplished by each child unit also having a receiver and listening to see if another child unit is transmitting. In such an example, the child unit only transmits when it detects or determines no other child units are transmitting. With this type of single receiver arrangement, the time durations that each child unit is to be monitored can be programmed within the parent unit, as discussed below, to achieve the function of cycling sequentially or hopping periodically among these separate child units.

Another way to accomplish this would be to include a transmitter in the parent units. In such an example, once the parent unit receives a transmission from a child unit, it can send a command for the next child unit to transmit. In this type of alternative single receiver arrangement, the time durations that each child unit transmits could again be programmable or adjustable within the parent unit, as discussed below, to achieve the function of cycling or listening sequentially or hopping continuously among the separate child units. There are a number of alternative options by which the monitoring time can be set with these types of Time Division Multiplexing systems. If the parent unit does not have a transmitter, the user can set the transmission time on each child unit. Alternatively, each child can be configured to transmit its data for a very short time, on the order of milliseconds. The parent unit would receive an essentially continuous stream of data from each child unit. The parent unit can then be programmed to choose which data stream to use and can cycle among the child unit data streams. If the parent unit does have a transmitter, the parent unit can be configured to send a command to the child units to set the transmission time for each unit. Such a command can be transmitted only when the user adjusts the monitoring times.

In a further example, a continuous transmission frequency hopping system could be employed in the child units. In such an example, each child unit can transmit continuously but use frequency hopping. In another words, the child unit transmission would pseudorandomly change frequency after a given period of time. Because the channel hopping sequence would be pseudorandom, the probability that each child unit would transmit over the same frequency at the same time would be significantly low. The parent unit can then employ one, two, or more receivers. The parent unit can continually scan all of the available child unit channels and receive a signal and emit the requisite parental notifications for a predetermined duration each time it locks onto a channel or frequency being transmitted by a child unit. The time that such a child unit would transmit on each channel before hopping to the next channel would be very short, again on the order of milliseconds. The receiver must hop channels at the same time as the transmitter in order to receive the data correctly. The pseudorandom channel hopping sequence would be predetermined or preprogrammed. Thus, the receiver would always know what channel to hop to next. The parent unit could have one receiver or multiple receivers. With one receiver, the parent unit can follow the hopping sequence for the first child unit for a period of time and then follow the hopping sequence for the second child unit for a period of time. With multiple parent unit receivers, each receiver can follow the hopping sequence for each child unit independently. The parent unit can then be configured or programmed to determine which audio data to send to the speaker.

The parent unit 22 in the disclosed example has a speaker amplifier 82, which can be employed to amplify the audio signals received and then deliver the signals to a speaker 84. The speaker 84 can emit audible sounds representative of the audio monitored by the units. The light bar region 64 can be connected and operable to indicate which child unit 24 is being monitored at any given time. The light bar region 64 can also be operable to identify the child unit 24 responsible for sound currently being emitted from the parent unit speaker 84, as well as to indicate the intensity or volume level of the monitored sound. As discussed below, the light bar region can be configured in a number of different manners and yet perform these and/or other functions as well.

In this example, the parent unit 22 has a microprocessor module 86 that differentiates or distinguishes between the signals transmitted by the two child units 24. The microprocessor module 86 can then process those signals from each receiver 80A and 80B. In this example, the microprocessor module 86 is configured to continuously and sequentially hop or cycle repeatedly between the multiple receivers, in this case the two receivers 80A and 80B. The processor can be programmed to listen to the frequency or channel of the first receiver 80A for a period of time, then listen to the channel or frequency of the second receiver 80B, and then continuously repeat the cycle. For systems with more than two child units, the parent unit will sequentially cycle between the frequencies or channels of each child unit and then repeat the cycle.

In this disclosed example, the time period or "listening" duration Δt during which the parent unit 22 listens for each child unit 24 can be independently adjusted by the user. Thus, the microprocessor 86 can be configured to permit altering the Δt for each unit separately. To accomplish this, the parent unit 22 can be provided with a separate time adjust button 88 (see FIGS. 1 and 2) on the unit shell. This control can be operated by the user to initiate adjustment of the time or Δt that the parent unit will listen for each child unit 24. The microprocessor module 86 communicates with the time adjustment button so that the button can at least notify the processor that time Δt is to be adjusted. The available Δt options for each child unit 24 can vary considerably. In one example, the Δt options can range nearly infinitely within a minimum and a maximum listening time range. In another example, a plurality of discrete Δt options can be selectively available to the user for each child unit. To illustrate, such a range of options can include an OFF or zero listening time option and additional options of 10 seconds, 30 seconds, 1 minute, and 2 minutes, for example, for each of the child units. The OFF option, if available, can in one example be a true "off" feature where the parent unit does not listen for the channel or frequency of the child unit set to this Δt option. Alternatively, the OFF option, if available, can set Δt to a very short period of time, such as a small fraction of a second, so that a user is not aware that this particular child unit is being monitored at all.

The procedures and components used to adjust the Δt for each child unit 24 can also vary considerably and yet fall within the spirit and scope of the present invention. In one example, a user can first select which child unit to adjust by setting to the selected child unit a room select switch 90 provided on the parent unit shell. The user can then depress the time adjust button 88. In one example, the button 88 can be configured so that it must be depressed while the adjustment procedure is carried out. Alternatively, the microprocessor module 86 and the button 88 can be coordinated to permit a window of time in which to carry out an adjustment after first depressing and releasing the button. If no room select switch 90 is present, the button 88 and microprocessor module 86 can alternatively be configured to scroll the available child units, depending upon how many times the button is depressed and/or according to a particular sequence of depressing the button or other components on the unit 22. Alternatively or additionally, the microprocessor module 86 can be configured to emit a signal from the parent unit speaker 84, such as a series of beeps, to identify to a user which child unit is currently selected or ready for adjustment. A series of beeps or other sounds and/or the volume of the sounds emitted from the speaker 84 can also be used to provide an indication as to the current Δt selected for a given child unit 24. In another example, the light bar 64 can be configured and utilized to provide various Δt notification functions, as described below.

In such an example, the light bar region 64 can be configured as shown on the parent unit 22 in FIG. 4. In this example, the light bar has a single series of lights 92A-92E and has separate child unit indicator lights 94A and 94B. One of the unit indicator lights 94A and 94B can be illuminated when the corresponding child unit is selected and ready for Δt adjustment, such as by setting the switch 90 and depressing the button 88. The series of lights 92A-92E can be used to indicate the particular Δt option selected for that particular unit. In one example, more lights in the series can be illuminated when a larger Δt is selected and fewer lights in the series can be illuminated when a smaller Δt is selected.

In the example shown in FIG. 4, the single series of lights 92A-92E can also act as the sound level meter and indicate in a conventional manner the intensity or sound level being monitored by a particular child unit 24. One of the corresponding unit indicator lights 94A or 94B can simultaneously illuminate along with the lights 92A-92E to indicate which child unit is being monitored and producing the indicated sound level.

In another example shown in FIG. 5, the light bar region 64 can have a different configuration. In this example, the loss-connection light 66 is positioned below and between a pair of side-by-side adjacent LED light bars, one for each of the child units 24. Each light bar in this example includes a series of five LED lights 100A-10E or 102A-102E. The two light bars can be provided with different color lights to further distinguish them. For example, the light bar 100A-100E can include orange or red lights and the light bar 102A-102E can include green or blue lights. In operation, one of the light bars will illuminate when the parent unit is monitoring or scanning the corresponding child unit 24 and will operate in a conventional manner.

During a time adjust sequence, the light bars 100 and 102 can be employed to show the selected Δt for the corresponding child unit 24. In this example, each light 100A-100E and 102A-102E in each light bar 100 and 102 is associated with a different Δt option. As shown in FIG. 5, the lower-most light 100A and 102A in each bar represents an OFF or zero "listening" time setting. The next lowest light 100B and 102B represents a 10 second or Δt setting. Similarly, the lights 100C and 102C represent a 30 second Δt, the lights 100D and 102D represent a 1 minute Δt, and the lights 100E and 102E represent a 2 minute Δt. In this example, the user can set the room select switch 90 to the desired child unit 24, depress the time adjust button 88 to begin Δt adjustment, and then set the desired Δt. In one example, the volume control switch 30 on the parent unit 22 can be operated after depressing the button 88 to change the Δt setting. After selecting which child unit is to be adjusted, the switch 30 can be toggled up or down until the correct light within the selected light bar is illuminated.

In the example shown in FIG. 5, the dual series of lights 100A-100E and 102A-102E each also act as the sound level meter for only one corresponding child unit and indicate in a conventional manner the intensity or sound level being monitored by the related child unit 24. When one of the light bars is illuminated, this indicates which child unit is being monitored and producing the audio level, if any.

Another alternative example of a light bar region 64 is shown in FIG. 6. In this example, only a single series of lights 110A-110E or is depicted in conjunction with a loss-connection light 66. In this example, each light 110A-110E is a dual color light, such as a dual-color LED. The microprocessor 86 of the parent unit can be configured to illuminate only one or the other of the colors of each the lights, such as red or orange, or green or blue. A particular color can show when a child unit 24, which corresponds to that color light, is being monitored, when the parent unit 22 is emitting sound from that first child unit, and/or when Δt is being adjusted. The processor can be configured to illuminate only the color that corresponds to each child unit 24.

Yet another alternative example of a light bar region 64 is shown in FIG. 7. In this example, only a single liquid crystal display (LCD) screen 120 is illustrated on the front of the parent unit shell along with a loss-connection light 66. In this example, the microprocessor 86 of the parent unit can be configured to illuminate or operate the LCD screen to display alphanumeric, graphical, and/or other information relevant to operational parameters and features of the system. For example, the screen can display visual information to identify or represent: a sound level meter to show the volume level of sound currently being monitored; which child unit(s) is(are) currently being monitored; the child units available and selectable for monitoring and/or adjustment; which child unit is currently being adjusted; adjustment levels for various adjustable characteristics of the system; battery levels; and the like.

The LCD screen 120 in the example of FIG. 7 can be replaced by any suitable display screen technology and yet function as intended. The display screen can also be a touch screen if desired. Even the light 66 can be eliminated in this example and replaced by a display function provided by the LCD or other display screen, if desired. In a modified example, an LCD or other display screen can be employed in conjunction with other lights such as those in the examples described above with respect to FIGS. 4-6. The LCD can be employed to supplement, duplicate, or replace any one or more of the light bar features and functions when used along with a light bar (series of lights) such as those in FIGS. 4-6.

In another example of the present invention, the monitor system can be configured to permit independent and separate volume level adjustment at the parent unit for each child unit. This feature can be incorporated in a system in conjunction with the "listening" time adjust feature or independent of such a feature. One example of this aspect of the present invention is discussed herein with respect to the previous figures and reference numbers.

In one example, the microprocessor module can be coupled with the volume adjustment switch 30 on the parent unit 22. The processor can be programmed to permit adjustment of the volume level for each of the child units 24 independently. As with the "listening" time or Δt adjustment noted above, the particular sequence and components used to accomplish this feature can vary and yet fall within the spirit and scope of the present invention. The speaker 84 can be incorporated with this adjustment process as can the various buttons and switches on the units.

In one example, a user can set the room selection switch 90 on the parent unit 22 to a selected one of the child units 24. By doing so, the appropriate light indicators can illuminate during the adjustment procedure, depending on which type of light bar region 64 is employed. For the light bar region of FIG. 4, the correct unit indictor 94A or 94B will illuminate and the light 92A-92E will reflect the adjusted volume level. For the region 64 shown in FIG. 5, the correct lights 100A-100E or 102A-102E will illuminate and reflect the adjusted volume level for the selected unit. For the region 64 in FIG. 6, the correct color of the dual-color lights will illuminate to reflect the adjusted volume level for the selected unit. The user can then manipulate the switch 30 up or down to raise or lower the volume level to be emitted from the speaker 84 for only the selected unit 24. For a selected child unit 24, no illuminated lights can reflect that the speaker is off for that unit. Fewer illuminated lights can indicate a lower volume adjustment and more illuminated lights can indicate a higher volume adjustment for the particular unit 24. The speaker can emit beeps or other sounds at a volume level that mirrors the volume level during adjustment.

The microprocessor module 86 can be programmed to store the selected volume levels for each child unit 24. After a particular adjustment process, the processor can also be configured to emit a predetermined light and/or sound indicator that a volume level has been stored. For example, during adjustment, if no buttons are depressed for a predetermined period of time, such as two seconds, the parent unit can emit a series of beeps to indicate that the selected volume level has been stored by the processor. A similar stored value indicator can be emitted upon completion of the above-described "listening" time or Δt adjustment procedure as well.

In each of the monitor system examples disclosed herein, it is possible to employ multiple parent units 22 as shown in FIG. 1. Each of the multiple parent units 22 can have the same function as the single parent units described in these examples. In such an example, a user can set up the multiple parent units 22 in different rooms within a house. They can then move between the rooms without having to transport a parent unit and yet still monitor their children. They can adjust each parent unit differently with respect to the "listening" time or Δt adjust feature, the volume adjust feature, or both, if these features are present on a given system. Thus, one parent unit in one room can be focused on one child and another parent unit in another room can be focused on another child if the parents want to split child monitoring duties.

Although certain multi-child monitor systems and features have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child monitor system comprising:

a first transmitter unit that can monitor audio at a first location and can transmit first signals representative of the audio from the first location;

at least a second transmitter unit that can monitor audio at a second location and can transmit second signals representative of the audio from the second location; and a receiver unit that can receive the first signals and the second signals, can emit a notification representing each of the first signals and the second signals, can sequentially listen for the first transmitter unit for a first duration and at least the second transmitter unit for a second duration during a listening cycle, and can continuously repeat the listening cycle, wherein the first duration and the second duration can be adjusted by a user to a different duration selected from a plurality of different duration options.

2. The child monitor system according to claim 1, wherein the first duration and the second duration can each be adjusted independent of the other to any one of the plurality of different duration options.

3. The child monitor system according to claim 2, wherein the first duration and the second duration can be adjusted to the same one of the plurality of different duration options.

4. The child monitor system according to claim 1, wherein the first duration and the second duration are both adjustable simultaneously to the same one of the different duration options.

5. The child monitor system according to claim 1, wherein the receiver unit has a visual indicator configured to provide a different visible indicator to an operator for each of the plurality of different duration options during adjustment.

6. The child monitor system according to claim 5, wherein the visual indicator is an LCD screen.

7. The child monitor system according to claim 1, wherein the receiver unit has a plurality of lights configured to illuminate differently for each of the plurality of different duration options during adjustment.

8. The child monitor system according to claim 7, wherein the plurality of lights are operable in series such that one previously non-illuminated light is illuminated for each greater duration of the plurality of different duration options.

9. The child monitor system according to claim 7, wherein the first duration and the second duration can each be adjusted independent of the other to any one of the plurality of different duration options, and wherein each light of the plurality of lights is a multi-color light and illuminates in one color during adjustment of the first duration and in a different color during adjustment of the second duration.

10. The child monitor system according to claim 9, wherein each multi-color light is an LED.

11. The child monitor system according to claim 1, wherein the first duration and the second duration can each be adjusted independent of the other to any one of the plurality of different duration options, the child monitor system further comprising:

a first series of lights on the receiver unit associated with the first transmitter unit and configured to illuminate differently for each of the plurality of different duration options during adjustment of the first duration; and a second series of lights on the receiver unit associated with the second transmitter unit and configured to illuminate differently for each of the plurality of different duration options during adjustment of the second duration.

12. The child monitor system according to claim 11, wherein the first series of lights illuminates in a different color than a color of the second series of lights, and each series of lights is operable such that one previously non-illuminated light in the series is illuminated for each longer duration of the plurality of different duration options.

13. The child monitor system according to claim 1, wherein the notification for each of the first and second signals is an audible notification, and wherein the receiver unit has a volume control that can be operated by a user to adjust a volume level of the audible notification for each of the first and second transmitter units independent of the volume level for the other transmitter units.

14. The child monitor system according to claim 13, wherein the first duration and the second duration can each be adjusted independent of the other to any one of the plurality of different duration options, the child monitor system further comprising:

a select switch on the receiver unit that can be actuated to select which of the first or second transmitter units is to be volume adjusted and which of the first or second durations is to be adjusted.

15. The child monitor system according to claim 13, further comprising:

a volume control switch on the receiver unit that can be operated to adjust the volume level for the first and second transmitter units and can be operated to adjust the first and second durations.

16. The child monitor system according to claim 1, wherein the first duration and the second duration can each be adjusted independent of the other to any one of the plurality of different duration options, the child monitor system further comprising:

a select switch on the receiver unit that can be actuated to select which of the first or second durations is to be adjusted.

17. The child monitor system according to claim 1, further comprising:

a volume control switch on the receiver unit that can be operated to adjust a volume level of audible notifications emitted by the receiver unit and can be operated to adjust the first and second durations.

18. The child monitor system according to claim 1, further comprising:

a microprocessor module in the receiver unit; and a time adjust button on the receiver unit that can be depressed to notify the microprocessor module to permit adjustment of the first and second durations.

19. The child monitor system according to claim 1, wherein the receiver unit can distinguish between the first signals and the second signals.

20. The child monitor system according to claim 19, wherein the receiver unit can distinguish between a transmission frequency of the first signals and a different transmission frequency of the second signals.

21. The child monitor system according to claim 1, further comprising:

at least a third transmitter unit that can monitor audio at a third location and can transmit third signals representative of the audio from the third location, wherein the receiver unit can receive the third signals, can emit a notification representing the third signals, can listen for the third transmitter unit for a third duration during each listening cycle, and wherein the third duration can be adjusted by a user to a different duration selected from the plurality of different duration options.

22. The child monitor system according to claim 1, wherein the third duration can be adjusted independent of the first and second durations to any one of the plurality of different duration options.

23. A monitor system comprising:

first and second child units that can each monitor audio at a different location and can each transmit signals representative of the audio monitored by the respective first and second child unit;

a parent unit that can receive the signals from the first and second child units; and a plurality of multi-color notification lights operational in series on the parent unit to identify a volume level of the audio monitored via a number of the plurality of multi-color notification lights that are illuminated and to identify one of the first and second child units via illumination of the number of illuminated lights in a first color when emitting the audio monitored by the first child unit and a second color different from the first color when emitting the audio monitored by the second child unit;

wherein the parent unit can emit a notification representing the audio monitored by each of the first and second child units, can sequentially listen for the first child unit for a first duration and the second child unit for a second duration during a listening cycle, and can continuously repeat the listening cycle.

24. The monitor system according to claim 23, wherein the multi-colored notification light is a dual-color LED.

25. The monitor system according to claim 24, wherein the dual-color LED can independently illuminate in both a green color and a red color.

26. The monitor system according to claim 23, wherein the first duration and the second duration can each be adjusted independent of the other by a user to a selected different duration.

27. The monitor system according to claim 23, wherein the parent unit has a speaker to emit an audible representation of the audio monitored.

28. The monitor system according to claim 27, wherein the parent unit has a volume control, that can adjust a volume level of the emitted audible representation for the first child unit and the second child unit independent of the volume level of the other child unit.

29. The monitor system according to claim 23, wherein the parent unit can distinguish between the signals from the first and second child units.

30. A monitor system, comprising:

first and second child units that can each monitor audio at a different location and can each transmit signals representative of the audio monitored by the respective first and second child unit;

a parent unit that can receive the signals from the first and second child units; and a plurality of multi-color notification lights operational in series on the parent unit to identify a volume level of the audio monitored via a number of the plurality of multi-color notification lights that are illuminated and to identify one of the first and second child units via illumination of the number of illuminated lights in a first color when emitting the audio monitored by the first child unit and a second color different from the first color when emitting the audio monitored by the second child unit;

wherein the parent unit can emit a notification representing the audio monitored by each of the first and second child units, can sequentially listen for the first child unit for a first duration and the second child unit for a second duration during a listening cycle, and can continuously repeat the listening cycle, wherein the first duration and the second duration can each be adjusted independent of the other by a user to a selected different duration.

31. A child monitor system comprising:

a plurality of transmitter units that can monitor audio at different locations wherein each of the plurality of transmitter units can transmit signals representative of the audio monitored by the respective transmitter unit;

a receiver unit that can receive the signals of the plurality of transmitter units and can emit an audible notification representing the audio monitored by each of the plurality of transmitter units; and a volume control in communication with the receiver unit that can be operated to adjust a volume level of the emitted audible notification for each of the plurality of transmitter units independent of the other transmitter units, and further operated to store the adjusted volume levels for the plurality of transmitter units.

32. The child monitor system according to claim 31, further comprising:

a series of lights on a part of the receiver unit that are sequentially coordinated with the volume control to indicate the adjusted volume level for one of the plurality of the transmitter units as it is being adjusted.

33. The child monitor system according to claim 31, further comprising:

a speaker of the receiver unit that is operably connected with the volume control to emit a sound at a volume level indicative of the adjusted volume level for each one of the plurality of the transmitter units as the volume level of each unit is being adjusted.

34. The child monitor system according to claim 31, wherein the volume control comprises:

a volume adjust switch on a shell of the receiver unit; and a microprocessor in the receiver unit coupled with the volume adjust switch and configured to control the volume emitted from the receiver unit for each of the plurality of transmitter units.

35. The child monitor system according to claim 31, wherein the receiver unit can sequentially listen for each of the plurality of transmitter units for a duration during a listening cycle and can continuously repeat the listening cycle, and wherein the duration is independently adjustable by a user for each of the plurality of transmitter units.

36. The child monitor system according to claim 31, wherein the receiver unit can distinguish between the signals from the plurality of transmitter units.

37. The child monitor system according to claim 31, further comprising:

a display screen on a part of the receiver unit that is coordinated with the volume control to visually indicate the adjusted volume level for one of the plurality of the transmitter units as it is being adjusted.

* * * * *

UNITED STATES PATENT AND TRADEMARK OFFICE

CERTIFICATE OF CORRECTION

PATENT NO. : 7,642,911 B2
APPLICATION NO. : 11/672693
DATED : January 5, 2010
INVENTOR(S) : Craig Desrosiers et al.

It is certified that error appears in the above-identified patent and that said Letters Patent is hereby corrected as shown below:

In the claims:
Column 13
claim 22, line 7, please delete "1" and replace with --21--

Signed and Sealed this

Third Day of August, 2010

David J. Kappos

David J. Kappos
*Director of the United States Patent and Trademark Office*